US010605042B2

(12) United States Patent
Yue et al.

(10) Patent No.: US 10,605,042 B2
(45) Date of Patent: Mar. 31, 2020

(54) SHORT MILLABLE PLUG FOR HYDRAULIC FRACTURING OPERATIONS

(71) Applicant: CNPC USA CORPORATION, Houston, TX (US)

(72) Inventors: Jianpeng Yue, Sugarland, TX (US); Peng Cheng, Sugarland, TX (US); Marvin Allen Gregory, Spring, TX (US); Xu Wang, Beijing (CN)

(73) Assignee: CNPC USA CORPORATION, Houston, TX (US)

( * ) Notice: Subject to any disclaimer, the term of this patent is extended or adjusted under 35 U.S.C. 154(b) by 296 days.

(21) Appl. No.: 15/254,506

(22) Filed: Sep. 1, 2016

(65) Prior Publication Data

US 2018/0058174 A1 Mar. 1, 2018

(51) Int. Cl.
*E21B 33/128* (2006.01)
*E21B 33/134* (2006.01)
*E21B 33/12* (2006.01)

(52) U.S. Cl.
CPC ..... *E21B 33/134* (2013.01); *E21B 33/1204* (2013.01); *E21B 33/128* (2013.01)

(58) Field of Classification Search
CPC ..... E21B 33/134; E21B 33/1293; E21B 33/1204; E21B 23/06; E21B 33/129; E21B 33/128; E21B 33/1292; E21B 33/12; E21B 33/124
See application file for complete search history.

(56) References Cited

U.S. PATENT DOCUMENTS 1,476,727 A * 12/1923 Quigg ..... E21B 33/1293 166/125
2,714,931 A * 8/1955 Bouvier ..... E21B 33/1293 166/119
3,000,443 A * 9/1961 Thompson ..... E21B 33/1293 166/135
3,091,293 A * 5/1963 Fry ..... E21B 23/06 166/123
3,285,343 A * 11/1966 Urbanosky ..... E21B 33/1293 166/134
4,784,226 A * 11/1988 Wyatt ..... E21B 23/06 166/182
6,131,656 A * 10/2000 Jani ..... E21B 33/1293 166/192
8,267,177 B1 * 9/2012 Vogel ..... E21B 33/1294 166/131
9,562,415 B2 * 2/2017 Frazier ..... E21B 33/129
(Continued)

*Primary Examiner* — Kipp C Wallace
(74) *Attorney, Agent, or Firm* — Craft Chu PLLC; Andrew W. Chu

(57) ABSTRACT

A short millable plug includes a mandrel, an upper backup ring and a lower backup ring, a cone, a slip that can be expand and engage a casing, a plurality of sealing elements that creates a seal between the mandrel and the casing, a centralizer that can radially expand to force against the casing wall, a mill-out anti-rotation feature at the middle of the mandrel which is exposed once the plug is set. The centralizer can keep the plug in the center of the casing and each individual slip segments of the slip has the same distance to the casing wall during setting and operation. The mill-out anti-rotation feature can reduce relative rotation between the plug and the casing while reduces the length of the plug.

20 Claims, 14 Drawing Sheets

(56) References Cited

U.S. PATENT DOCUMENTS

| | | | | |
|---|---|---|---|---|
| 2008/0073074 | A1* | 3/2008 | Frazier | E21B 33/1294 166/138 |
| 2010/0263876 | A1* | 10/2010 | Frazier | E21B 33/129 166/378 |
| 2010/0276159 | A1* | 11/2010 | Mailand | E21B 33/129 166/382 |
| 2014/0166317 | A1* | 6/2014 | Gregory | E21B 33/134 166/387 |
| 2015/0176366 | A1* | 6/2015 | Chenault | E21B 33/1204 166/133 |
| 2015/0191992 | A1* | 7/2015 | Liu | E21B 23/06 166/122 |
| 2017/0198544 | A1* | 7/2017 | Moore | E21B 33/1293 |
| 2017/0362912 | A1* | 12/2017 | Smith | E21B 33/1204 |

* cited by examiner

SHORT MILLABLE PLUG FOR HYDRAULIC FRACTURING OPERATIONS

FIELD

The disclosure relates generally to methods and apparatus for drilling and completing well bores. The disclosure relates specifically to methods and apparatus for plugs.

BACKGROUND

In the drilling, completing of oil wells, it is often necessary to isolate particular zones within the well. In some applications, downhole tools, known as bridge plugs, fracture ("frac") plugs, and the like, are inserted into the well to isolate zones. The purpose of the bridge plug or frac plug is to isolate some portion of the well from another portion of the well. For example, perforation in the well in one portion may need to be isolated from perforations in another portion of the well, or there may be a need to isolate the bottom of the well from the wellhead. Accordingly, the plug may experience a high differential pressure, and must be capable of withstanding the pressure so that the plug seals the well and does not move in the well after being set.

Because downhole tools are used in a wide range of well bore environments, they must be able to withstand extremes of high temperature and pressure. During normal well completion operation, the downhole tools must be removed to allow the installation of tubing to the bottom of the well to begin the recovery of oil or gas.

A plug is generally comprised of one or two slips and cones as well as an elastomeric packing element arranged about a mandrel that is run into the wellbore. The slip may be initially formed in a ring, and designed to break apart upon the application of an axial force. The slip includes a tapered surface that is adapted to mate with a tapered surface of the cone. As an axial force is applied to the plug, relative movement between the slip and the cone happens, the slip moves up on the tapered surface of the cone and breaks apart to form a number of individual slip elements, and the slip elements are driven outwardly, away from the mandrel, and thus engages the casing wall, locking the slip in place within the casing.

Further application of axial force compresses the elastomeric packing element, driving the packing element outwardly to contact and seal against the wellbore. The axial compression of the packing element causes the packing element to expand radially against the well casing creating a sealing barrier that isolate a portion of the well.

Unfortunately, it has been found that once the plug is set, if the slip is not centered within the wellbore the slip elements may not be uniformly disposed around the inside walls of the casing. This non-uniform position of the slip elements results in uneven stress distribution around the mandrel. An uneven stress distribution may limit the axial load capacity of the slip and may result in movement of the plug over time as it is used in the casing, which results in a loss of seal or damage to other well components.

When it is desired to remove one or more of these plugs from a wellbore, it is often simpler and less expensive to mill or drill them out rather than to implement a complex retrieving operation. In milling, a milling cutter is used to grind the plug. In drilling, a drilling bit is used to cut and grind up the components of the plug to remove it from the wellbore. Problems sometimes occur during the milling or drilling of the plug. For instance, the plug components can bind upon the drilling bit and rotate with it within the casing.

Such binding can result in extremely long drill-out times, excessive casing wear, or both. Long drill-out times are highly undesirable, as rig time is typically charged by the hour.

Disadvantages with prior art plugs can be excessive length of the plugs since all of the above combined systems require length. It would advantageous to have a short plug, so if plug removal is required, milling time would be greatly reduced.

In light of the foregoing, there exist a need for a plug that forces the slip into the casing wall to distribute the load more uniformly when set into the wellbore, thereby improving the axial load capacity of the slip. Further, a plug that can be easily, quickly, and reliably removed from the wellbore may also be desirable.

SUMMARY

In one aspect, the embodiments disclosed herein relate to a drillable frac plug including a mandrel having an upper end and a lower end, wherein the upper end and lower end of the mandrel include threads disposed on an outer surface of the mandrel, a plurality of sealing elements disposed around the mandrel, an upper backup ring and a lower backup ring disposed around the mandrel, the upper backup ring disposed above an upper end of the sealing elements and the lower backup ring disposed below a lower end of the sealing elements, a cone disposed around the mandrel proximate a lower end of the lower backup ring, a slip disposed around the mandrel adjacent a slope surface of the cone, wherein the slip comprises a plurality of slip segments and a plurality of recessed regions configured to facilitate breaking the slip into the plurality of slip segments, and each of the plurality of slip segments being configured to secure a casing wall, a bottom locking ring disposed around the mandrel proximate a lower end of the slip which can hold the slip on the mandrel, a centralizer disposed around the mandrel proximate an upper end of the upper backup ring that, when subjected to an axial force, cause the centralizer to radially expand to force against the casing wall; wherein, the axial force is smaller than a force required to shear the shearable connection between the cone and the mandrel.

In another aspect, the embodiments disclosed herein relate to a frac plug including a mandrel having an upper end and a lower end, wherein the upper end and lower end of the mandrel include threads disposed on an outer surface of the mandrel, a plurality of sealing elements disposed around the mandrel, an upper backup ring and a lower backup ring disposed around the mandrel, the upper backup ring disposed above an upper end of the sealing elements and the lower backup ring disposed below a lower end of the sealing elements, a cone disposed around the mandrel proximate an lower end of the lower backup ring, a slip disposed around the mandrel adjacent a slope surface of the cone, wherein the slip comprises a plurality of slip segments and a plurality of recessed regions configured to facilitate breaking the slip into the plurality of slip segments, and each of the plurality of slip segments being configured to secure a casing wall, a bottom locking ring disposed around the mandrel proximate a lower end of the slip which can hold the slip on the mandrel, a first anti-rotation feature is formed in the middle of the mandrel while a second anti-rotation feature is formed at the bottom or the plug, a sharp undercut formed on the inner surface of the mandrel, which produces a shearable portion of the mandrel between an upper end face of the mandrel and the sharp undercut, wherein, the shearable portion of the mandrel and the first anti-rotation feature are covered by components of the plug arranged on the mandrel when the plug is in an unexpanded condition while the whole shearable portion or the mandrel and at least a part of the first anti-rotation feature are exposed and the shearable portion or the mandrel is sheared when the plug is set; inner threads located at the inner surface of the shearable portion of the mandrel, wherein the second anti-rotation feature of a upper plug is complementary and adapted to engage the first anti-rotation feature of a lower plug when the two plugs are set and located in series, thereby preventing relative rotation therebetween.

In yet another aspect, the embodiments disclosed herein relate to a method of setting a drillable frac plug including applying an upward axial force to a mandrel, applying a first downward axial force to a centralizer, compressing the components between the centralizer and a cone of the plug, making the centralizer radially expand to force the centralizer against a casing wall, wherein the first downward axial force is smaller than the force required to shear a shearable connection between the cone and the mandrel, applying a second downward axial force to the centralizer, radially expanding a slip to engage the casing, wherein the second downward axial force is large enough to shear the shearable connection between the cone and the mandrel, applying a third downward axial force to the centralizer, compressing the sealing elements and radially expanding the sealing elements and creating a seal between the sealing elements and the casing, wherein the third downward axial force is larger than the second downward axial force.

In yet another aspect, the embodiments disclosed herein relate to a method of setting a drillable frac plug including connecting a ram of a setting tool with a shearable portion of a mandrel, applying an upward axial force to the mandrel, applying a first downward axial force to a lock ring retainer, a lock ring, and an upper backup ring, compressing the components between the backup ring and a bottom locking ring of the plug, radially expanding a slip to engage the casing, compressing sealing elements and radially expanding the sealing elements and creating a seal between the sealing elements and the casing, making a shearable portion of the mandrel and at least part of the first anti-rotation feature exposed, wherein the first downward axial force is smaller than the pulling force required to shear the shearable portion of the mandrel, applying a second downward axial force to the upper backup ring, and separating the shearable portion from the mandrel.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

Like elements in the various figures are denoted by like reference numerals for consistence.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

Figure 1A:
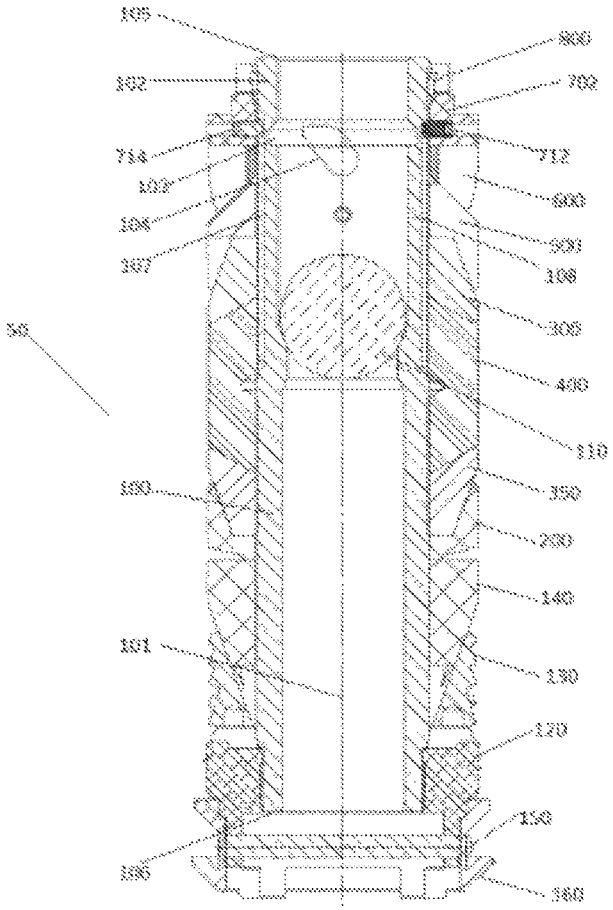
FIG. 1A and FIG. 1B are cross-sectional views of a frac plug in accordance with embodiments disclosed herein in the unexpanded configuration and the expanded configuration, respectively.

Referring to FIG. 1A, a cross-sectional view of a frac plug in accordance with one embodiment of the present disclosure is shown in an unexpanded condition, or after having been run downhole but prior to setting it in a wellbore. The unexpanded condition is defined as the state in which a plug is run downhole and before a force is applied to radially expand and engage the casing wall and set the plug in the wellbore. The frac plug 50 comprises a mandrel 100 having a longitudinal axis 101, about which other components of the frac plug 50 are mounted. The mandrel 100 includes an upper end 105 and a lower end 106 and a threaded outer surface 109 at the upper end, wherein the upper end 105 and the lower end 106 of the mandrel 100 include a threaded connection, for example, a ratchet thread, and an intermediate portion of the mandrel 100 is smooth. The mandrel 100 includes a through hole that allows for production through the frac plug 50, and a frac ball 110 seated in the through hole configured to regulate or check fluid flow therethrough.

The terms "up" and "down"; "upper" and "lower"; "upwardly" and downwardly"; "above" and "below"; and other like terms as used herein refer to relative positions to one another and are not intended to denote a particular direction or spatial orientation.

The mandrel 100 can be formed of a material that is easily drilled or machined, such as cast iron, fiber and resin composite, and the like. In the case where the mandrel 100 is made of a composite material, the composite article can include a tetrafunctional epoxy resin with an aromatic diamine curative. Other types of resin articles such as bismaleimide, phenolic, thermoplastic, and the like can be used. The fibers can be glass fibers or carbon fibers that can be used for high temperature applications.

Referring to FIGS. 1A to 3, a center element 400 is disposed around the mandrel 100, the center element 400 can have an outer diameter just slightly smaller than the diameter of well casing (not shown) and can be compressible along the longitudinal axis 101 of the mandrel 100 and radially expandable in order to form a seal between the mandrel 100 and the casing wall in a wellbore. The frac plug 50 may further include two end elements, upper end element 300 and lower end element 350, each deposed adjacent an end of the center element 400. In one embodiment, the center element 400 has two tapered outer surfaces at both ends thereon, such that the outer diameters of the both ends increase in an axial direction toward the center of the center element 400. Each of the two end elements 300, 350 has a conical inner surface configured to engage the tapered outer surface of the center element 400, therefore the two end elements 300, 350 can prevent the center element 400 from extruding. The end elements 300, 350 and the center element 400 are sealing elements that prevent fluid from communicating between the upper and lower zones when a pressure differential is applied to the frac plug 50. The end elements 300, 350 and the center element 400 may be formed from any material capable of expanding and sealing an annulus within the casing. The end elements 300, 350 and the center element 400 are preferably constructed of one or more synthetic materials capable of withstanding high temperatures and pressures, for example, elastomers, rubbers, blends and combinations thereof. The end elements 300, 350 and the center element 400 may be formed from the same material or from different materials. Preferably, the center element 400 may be of a different material than the end elements 300, 350, preferably having a lesser hardness than the end elements 300, 350.

Figure 1B:
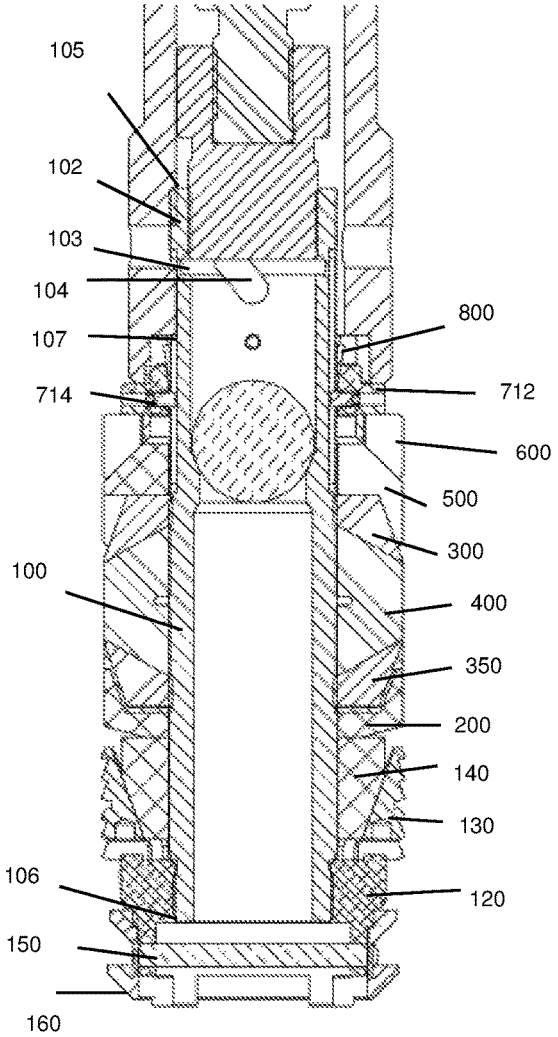
Figure 2:
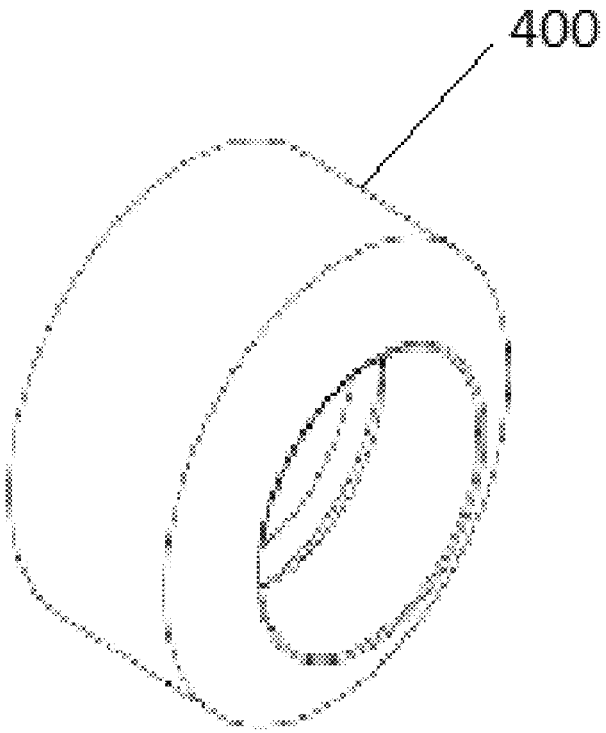
FIG. 2 is a perspective view of a center element in accordance with embodiments disclosed herein.
Figure 3:
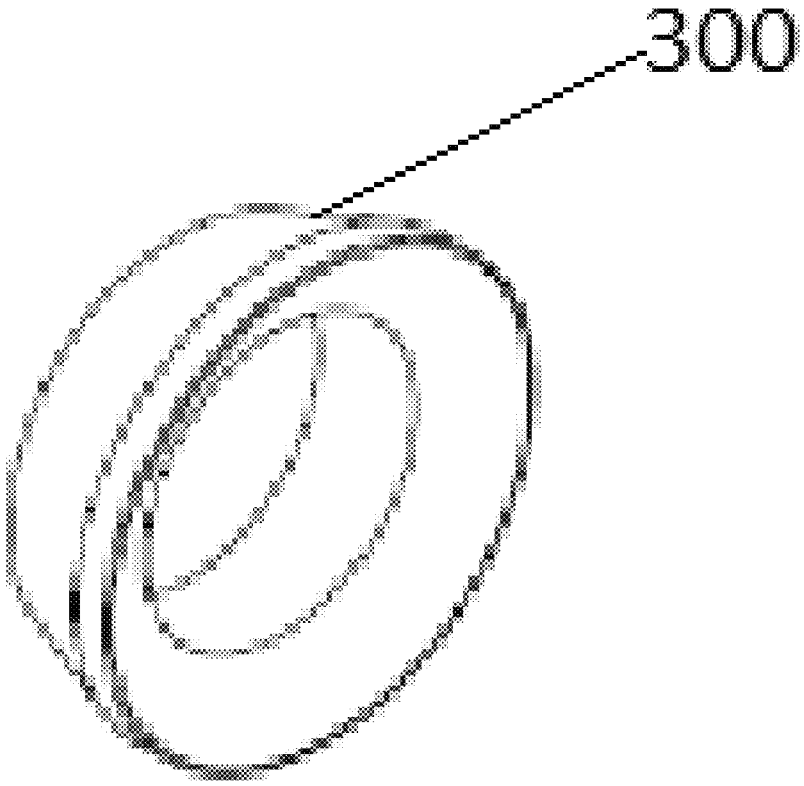
FIG. 3 is a perspective view of an end element in accordance with embodiments disclosed herein.
Figure 4:
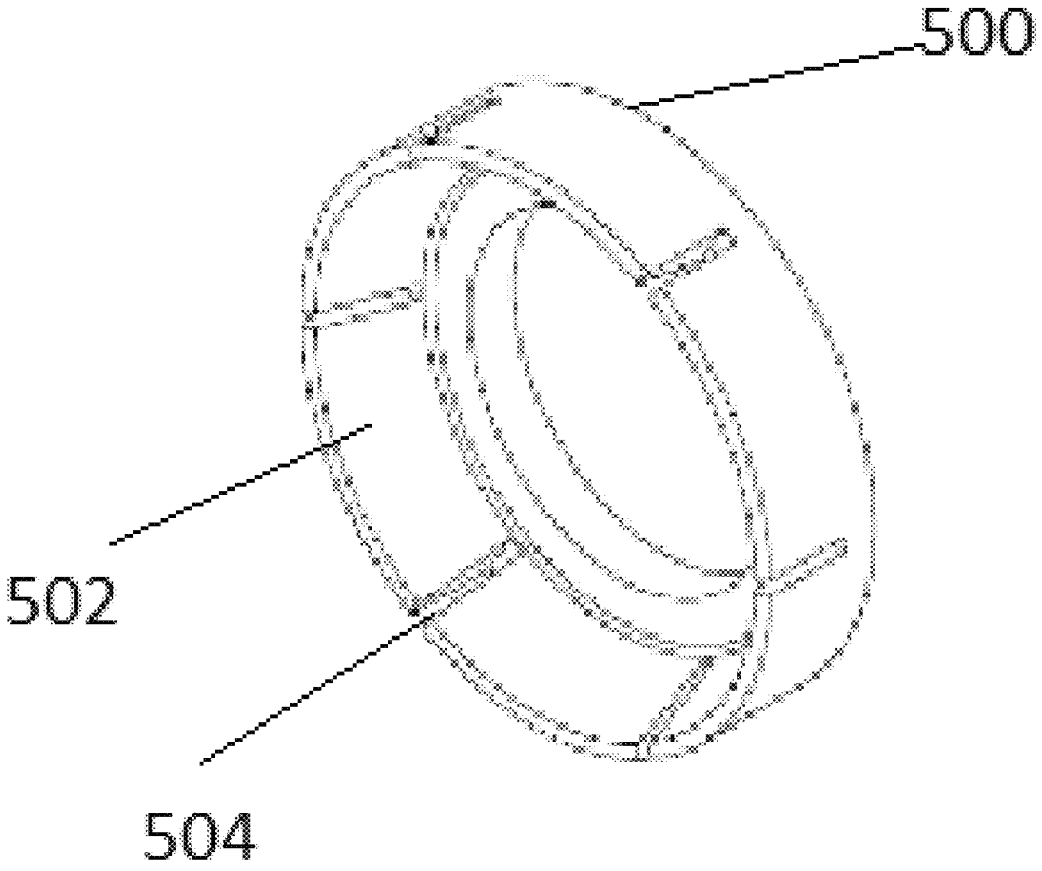
FIG. 4 is a perspective view of a backup ring in accordance with embodiments disclosed herein.

Referring to FIGS. 1A, 1B, and 4, the frac plug 50 may further include an upper backup ring 500 and a lower backup ring 200, each of the two backup rings 200, 500 disposed around the mandrel 100 and proximate outside each of the end elements 300,350 and configured to support the seal elements from the pressure differential. The upper backup ring 500 is arranged above the upper end element 300 and the lower backup ring 200 is arranged below the lower end element 350. The backup rings 200, 500 can be sized so as to bind and retain opposite ends of the end elements 300, 350.

In accordance with one embodiment disclosed herein, the backup ring 500 can include a plurality of backing segments 502 that are deposed circumferentially around the backup ring 500, a plurality of fracture regions 504 can be deposed between respective backing segments 502. The plurality of fracture regions 504 can join the backing segments 502 together and form the backup ring 500. The fracture regions 504 can fracture the backup ring 500 into the plurality of backing segments 502 when the axial force induces stress in the fracture regions 504. The backing segments 502 can be sized and shaped to reduce longitudinal extrusion of the end element 300. The upper backup ring 500 and the lower backup ring 200 can have the same construction and can be formed from any material known in the art, for example, an aluminum alloy.

Figure 5:
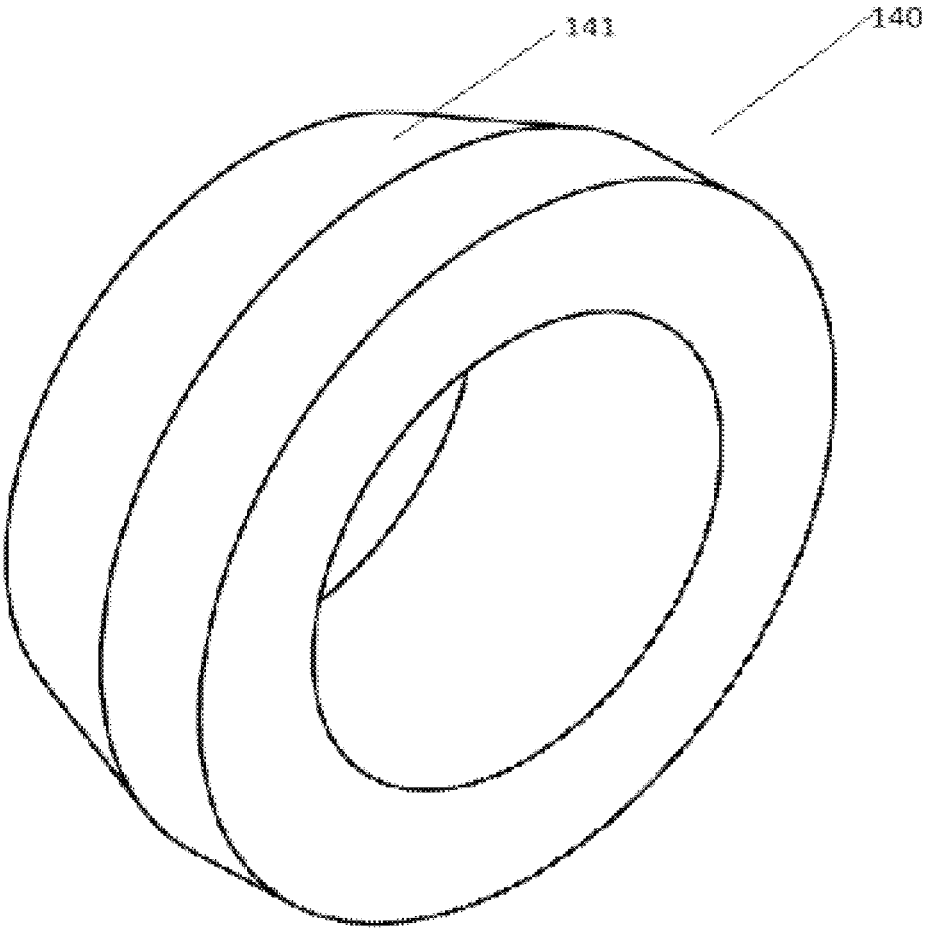
FIG. 5 is a perspective view of a cone in accordance with embodiments disclosed herein.

Referring to FIGS. 1A, 1B, and 5, the frac plug 50 further includes a cone 140 disposed around the mandrel 100 and adjacent the backup ring 200. The cone 140 has a sloped outer surface 141, such that when assembled on the mandrel 100, the outer diameter of the cone 140 increases in an axial direction toward the backup ring 200. In one embodiment, one or more shearable threads (not shown) can be formed on an inner surface of the cone 140.

In accordance with one embodiment disclosed herein, to temporarily hold the cone 140 in place on the mandrel 100, one or more shearable threads (not shown) can be disposed or formed on an outer surface of the mandrel 100 to engage with the shearable threads of the cone 140. The number, pitch, pitch angle, and depth of the shearable threads can vary depending on the force required to shear, break, or otherwise deform the shearable threads. The shearable threads can be adapted to shear, break, or otherwise deform when exposed to a predetermined force, releasing the cone 140 engaged with the mandrel 100 so the cone 140 can freely slide alone the mandrel 100.

Another example of temporarily holding the cone 140 in place on the mandrel 100 is a shearable pin. In this case, a shear pin (not shown) may be inserted through an aperture (not shown) on the cone 140 temporarily connecting the cone 140 and the mandrel 100 together. The shearable pin can be adapted to shear when exposed to a predetermined force, releasing the cone 140 engaged with the mandrel 100, thereby allowing the cone 140 to freely slide along the mandrel 100.

Figure 6:
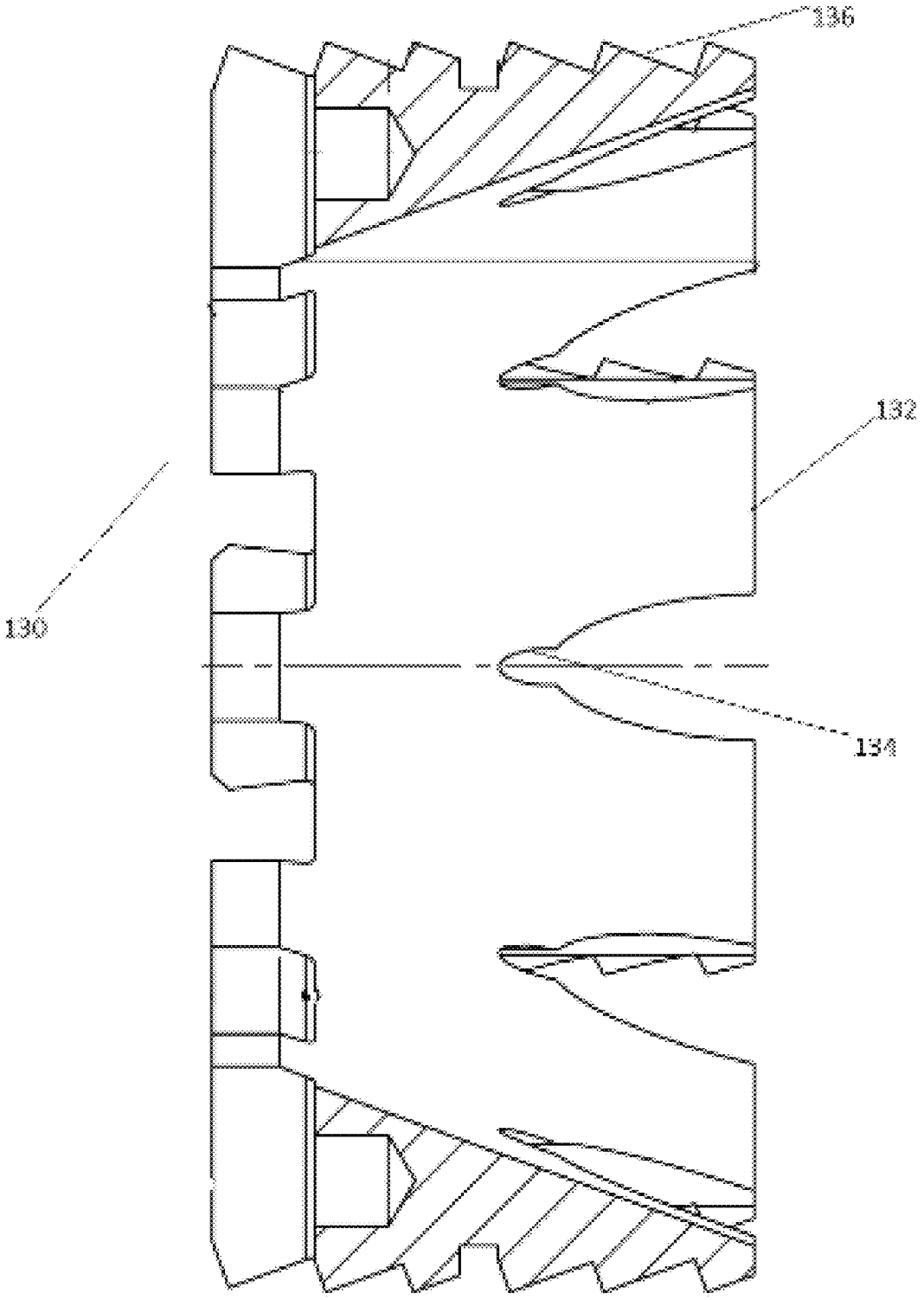
FIG. 6 is a partial perspective view of a slip in accordance with embodiments disclosed herein.
Figure 7:
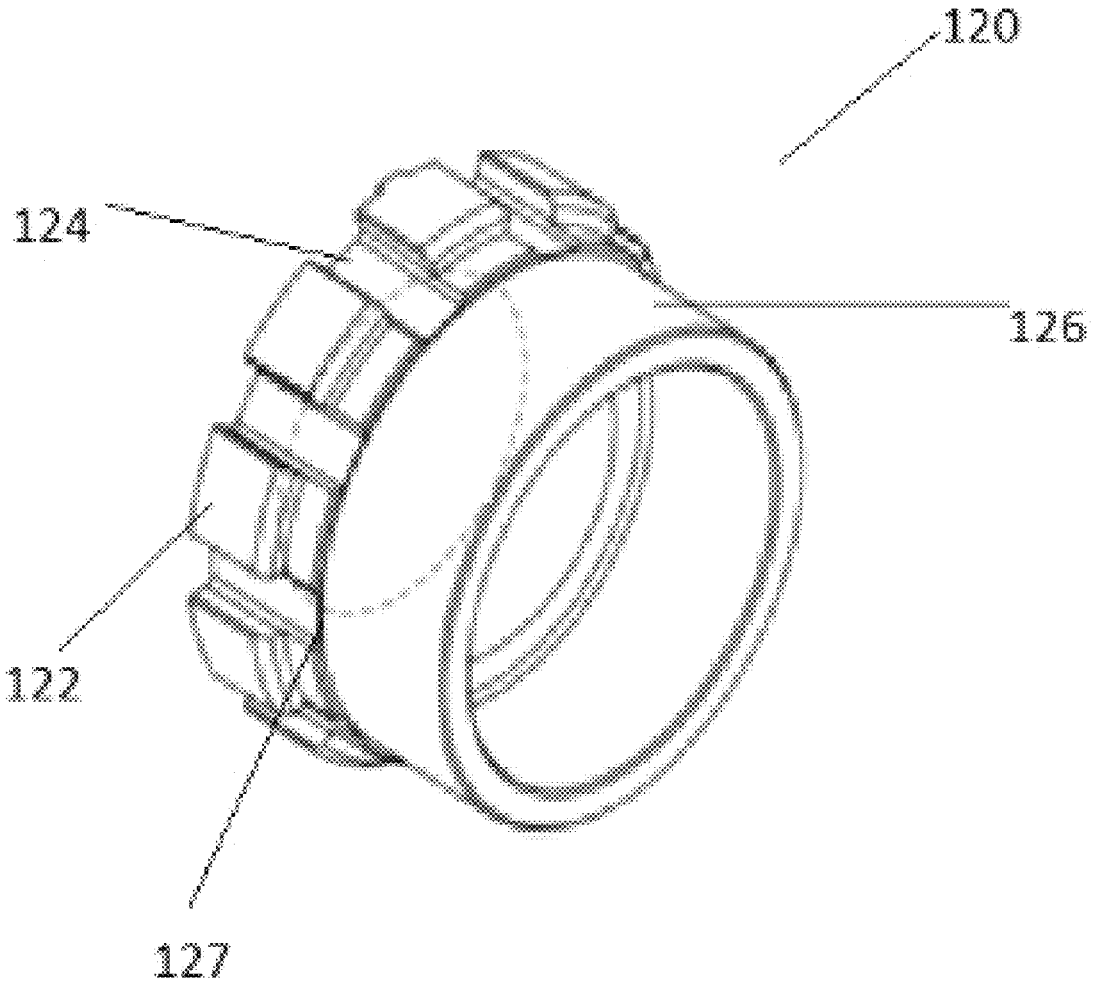
FIG. 7 is a perspective view of a bottom locking ring in accordance with embodiments disclosed herein.
Figure 8:
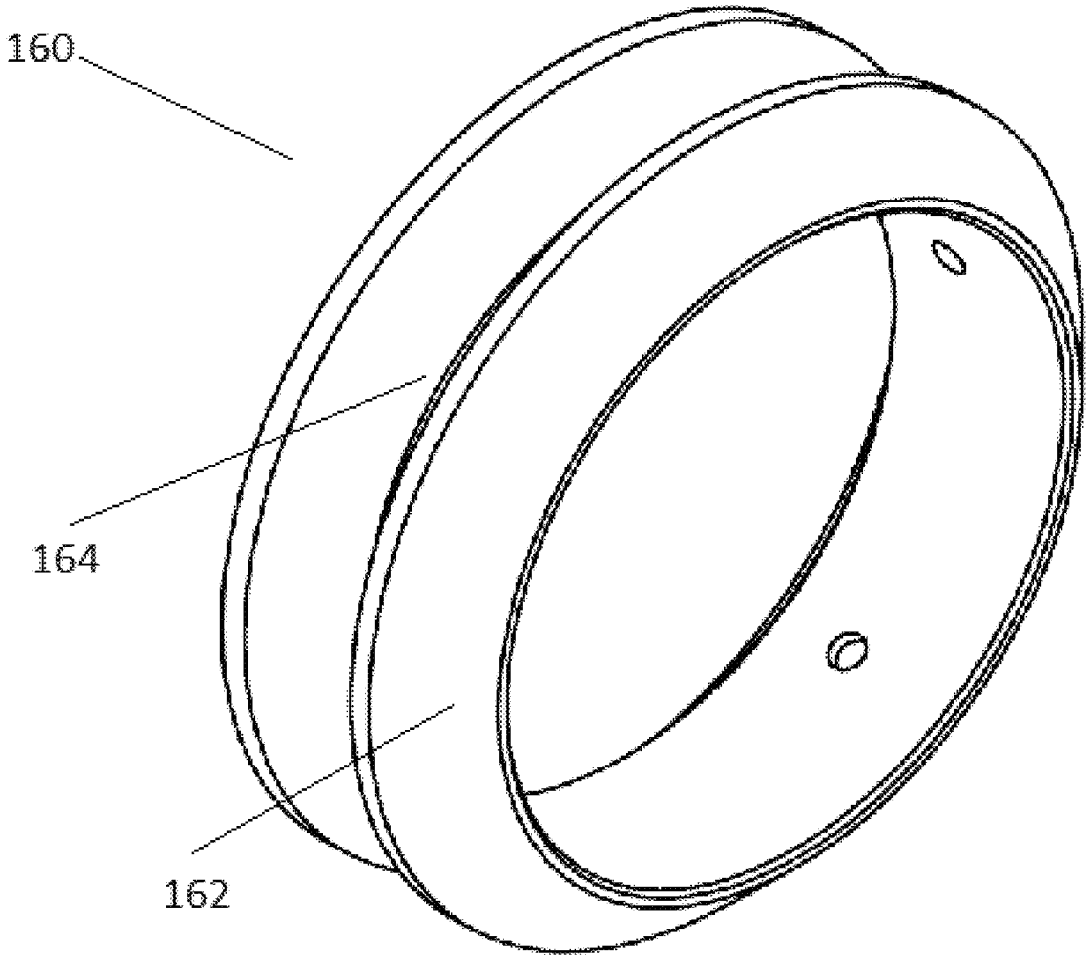
FIG. 8 is a perspective view of a seal in accordance with embodiments disclosed herein.

Referring to FIGS. 1A, 1B, and 6, a slip 130 is disposed below the cone 140. The slip 130 has a sloped inner surface adapted to rest on a complementary sloped outer surface of the cone 140. As explained in more detail below, the slip 130 travels about the surface of the cone 140, thus expanding radially outward from the mandrel 100 to engage an inner surface of a casing wall.

The outer surface of the slip 130 can include a plurality of slip segments 132 to engage an inner surface of a surrounding casing wall, as the slip 130 move radially outward from the mandrel 100 due to the axial movement across the adjacent cone 140. The slip 130 can further include a plurality of recessed regions 134 milled or otherwise formed between the slip segments 132. The recessed regions can facilitate longitudinal fractures to break the slip 130 into the plurality of slip segments 132. Each of the plurality of slip segments can be configured to be displaceable radially to secure the plug 50 in the well casing. The slip segments 132 can have a plurality of raised ridges 136, which can be sized and shaped to bite into the casing wall. Thus, when an outward radial force is exerted on the slip, the recessed regions 134 can break the slip 130 into the separable slip segments 132 that can bite into the casing wall and wedge between the plug 50 and the casing wall. In this way, the slip segments 132 can secure the plug 50 in a desired location in the casing.

The slip 130 can be formed of a material that is easily drilled or machined so as to facilitate easy removal of the plug 50 from a casing. For example, the slip 130 can be formed of a cast iron or composite material. Additionally, the recessed regions 134 can be formed by stress concentrators, stress risers, material flaws, notches, slots, variation in material properties, and the like, that can provide a weaker region in the slip 130.

Referring to FIGS. 1A, 1B. 7 and 8, a bottom locking ring 120 is disposed under the slip 130 and located at the bottom of the mandrel 100. The bottom locking ring 120 includes an upper end 124 adjacent to the slip 130 and a lower end 126 extending downward. Internal threads (not shown) are located at the inner surface of the upper end 124 and configured to thread with external threads (not shown) around the mandrel 100. The upper end 124 has a plurality of radial thickened parts 122 corresponding to the slip segments 132 of the slip 130 and the thickened parts 122 engage the slip segments 132 of the slip 130 respectively to prevent the slip 130 from moving in the axial direction. The lower end 126 of the bottom locking ring 120 extends outside of the mandrel and a seal 160 is set on the surface of it. Each of the lower end 126 and the seal 160 has two through holes extending in the radial direction. The through holes on the lower end 126 and the seal 160 are aligned to make the retainer bar 150 pass through them. The outer diameter of the lower end 126 is smaller than the outer diameter of the upper end 124 of the bottom locking ring 120, such that there is a step 127 between the upper end 124 and lower end 126 of the bottom locking ring 120. When the seal is mounted on the lower end 126, the upper end of the seal 160 is aligned with the step 127, which can facilitate the positioning of the seal 160. The seal 160 includes a ring body 162 and a cylindrical recess 164 in the thickness direction. When the plug 50 is lowered through the well casing, the seal 160 is located at the lowest position of the frac plug 50 and can prevent the plug 50 from suffering damage. The seal 160 can be formed of a material that is resilient, for example, elastomers, rubbers, blends and combinations thereof.

Figure 9:
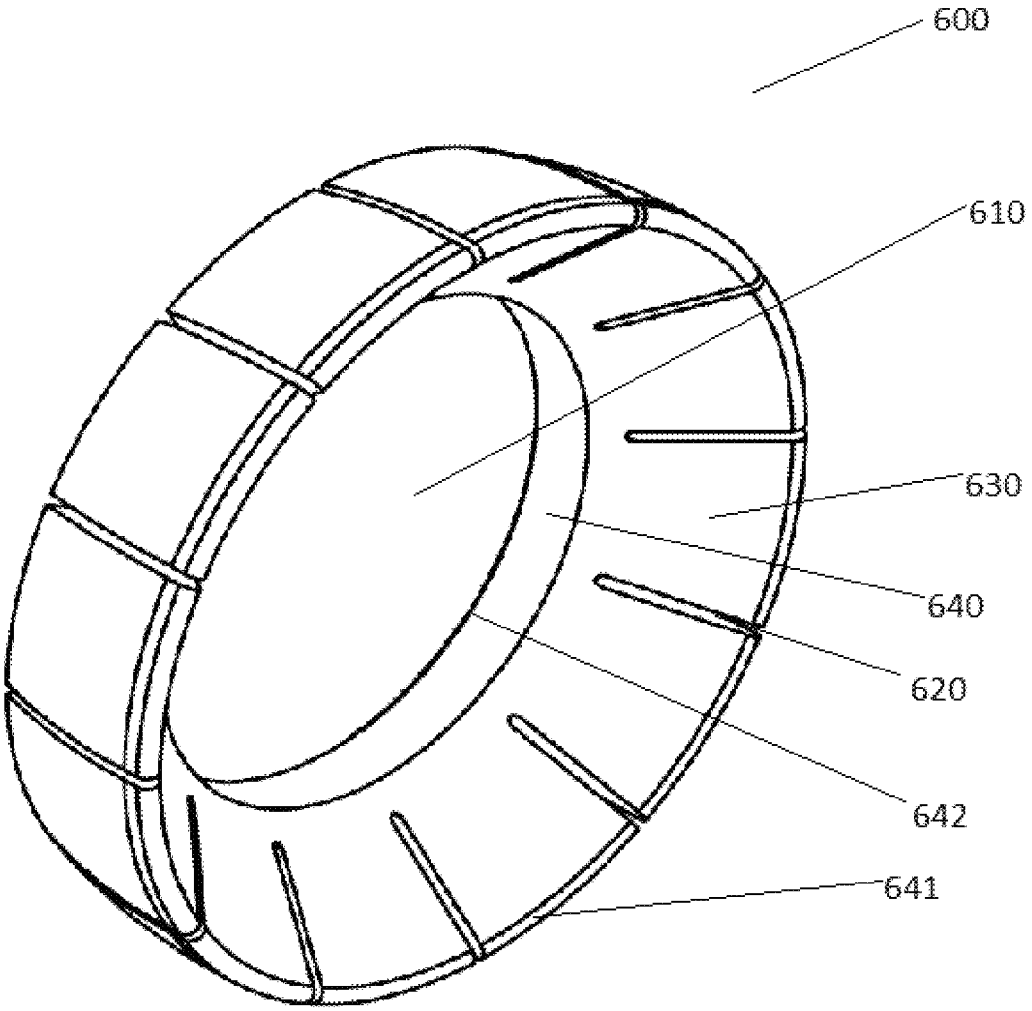
FIG. 9 is a perspective view of a centralizer in accordance with embodiments disclosed herein.

Referring to FIGS. 1A, 1B, and 9, the frac plug 50 further includes a centralizer 600 disposed adjacent above the upper backup ring 500, and is configured to keep the plug 50 in the center of the casing during setting and operation. As shown in FIG. 9, a centralizer 600 in accordance with embodiments disclosed herein has a cylindrical body 640 that has a conical inner surface configured to engage the sloped outer surface of the upper backup ring 500. The cylindrical body 640 has a circular opening 610 therein such that the centralizer 600 is configured to slide over the mandrel 100 into position adjacent the upper backup ring 500. A plurality of slits 620 are disposed on the cylindrical body 640 of the centralizer 600, each slit 620 extending axially from a second end 641 to a location behind a first end 642 of the centralizer 600, thereby forming a plurality of flanges 630. Centralizer 600 may be formed from any material known in the art. In one embodiment, centralizer 600 may be formed from a composite material, such as reinforced plastics, metal composites or ceramic composites.

Figure 10:
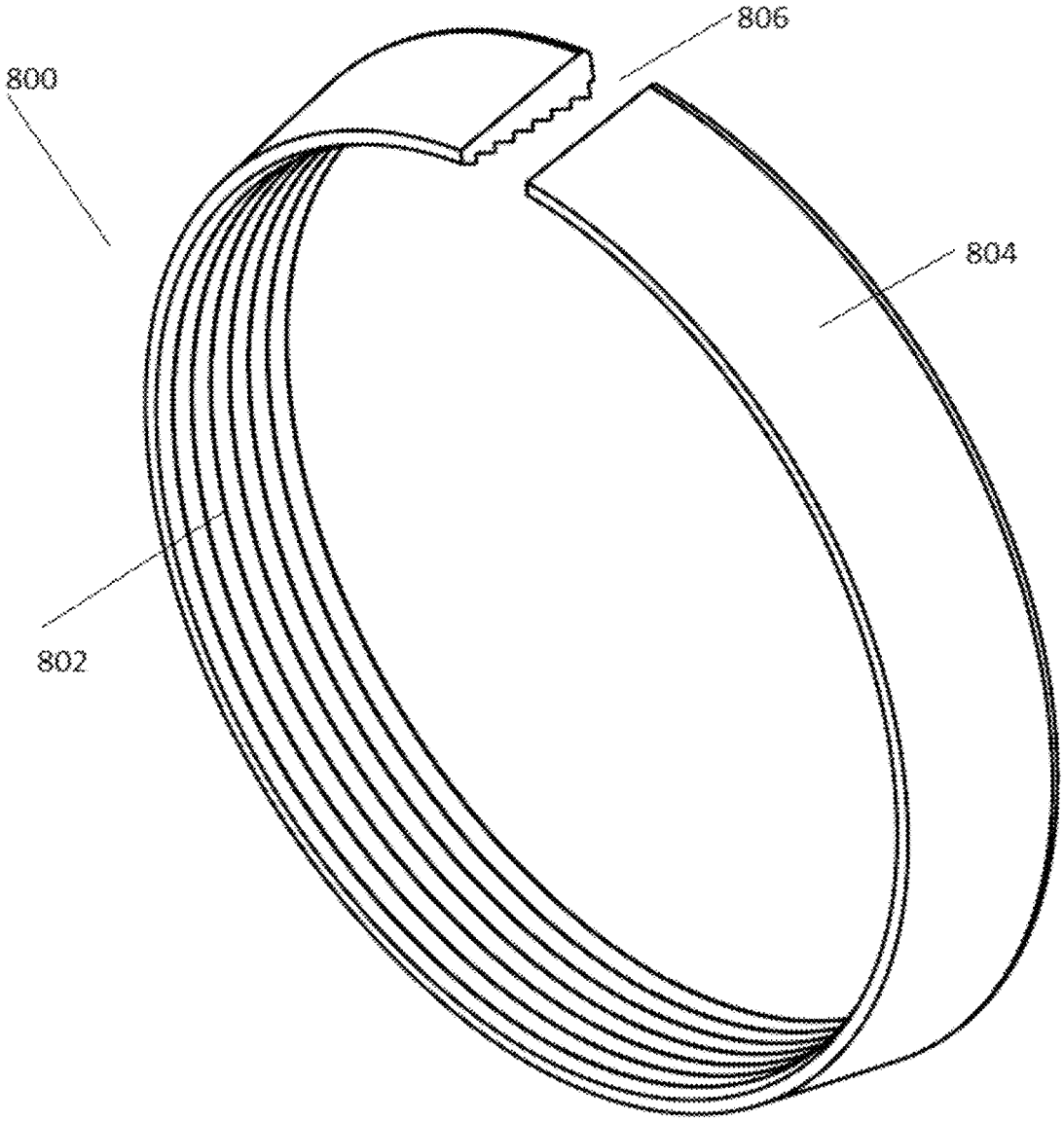
FIG. 10 is a perspective view of a lock ring in accordance with embodiments disclosed herein.

Referring to FIGS. 1A, 1B, and 10, a lock ring 800 is disposed adjacent above the centralizer 600. The lock ring 800 is annular shaped and has a threaded bore 802 with smooth exterior surface 804. The threaded bore 802 is of similar thread, for example, ratchet thread, to that of the threaded upper end 105 of the mandrel 100 for threadingly securing the lock ring 800 in a desired position along the longitudinal length of the mandrel 100. The lock ring is preferably a split ring having a longitudinally extending slot 806 which extends completely through a sidewall of the lock ring 800, preferably parallel to the longitudinal axis 101.

The longitudinally extending slot 806 extends the full length of and through the sidewall to allow the lock ring 800 to expand and open. The one way threads between the lock ring 800 and the mandrel 100 are configured such that the lock ring 800 will expand in response to the lock ring 800 moving downward over the mandrel 100, but the lock ring will not expand as the lock ring moves upward over the mandrel. This avoids upward slippage caused by expansion of the compressed elements of the frac plug 50 such that the compressed elements will remain firmly secured within the casing.

Referring to FIGS. 1A, 1B, 1I and 12, two through slots 104 are formed on the mandrel 100, they have a distance from the upper end face of the mandrel 100 and are symmetric about the longitudinal axis 101 of the mandrel 100. When the frac plug 50 is in an unexpanded condition, components on the mandrel extend over the full mandrel 100 and cover the through slots 104. After the frac 50 is set and the components on the mandrel 100 are compressed, a part of the mandrel 100 near the upper end face of the mandrel 100 will be exposed. The distance between two through slots 104 and the upper end face of the mandrel 100 is set as follows, after the frac plug 50 is set and the components on the mandrel 100 are compressed, at least part of the through slots 104 will be exposed.

Being adjacent to the through slots 104, a sharp undercut 103 is formed on the inner surface of the mandrel 100 and thus providing a shearable portion 102 of the mandrel 100 between the upper end 105 and the sharp undercut 103. The sharp undercut 103 greatly reduces the tensile strength of the shearable portion 102 relative to the mandrel 100, at the same time, the compressive strength between the shearable portion 102 and the mandrel 100 is reduced very little by the undercut 103. By this arrangement, the shearable portion 102 is designed so that it can be forcibly separated from the mandrel when enough pulling force is applied between the shearable portion 102 and the mandrel 100.

Referring to FIGS. 1A, 1B, 13 and 14, when the frac plug 50 is set, a downward force is applied to centralizer 600 via a setting tool 700 while the mandrel 100 is pulled upwardly. The setting tool 700 includes a tool sleeve 703 and a ram 704, and the ram 704 has outer threads (not shown) around the outer surface of the end thereof configured to thread with inner threads (not shown) located at the inner surface of the shearable portion 102 of the mandrel 100, such that the ram 704 can be firmly connected with the shearable portion 102 of the mandrel 100. The tool sleeve 703 contacts the lock ring 800 and lock ring retainer 702 to expand the centralizer 600. Two threaded through holes extending in the radial direction near the end of the lock ring retainer 702 and are aligned with the mill slots 107, 108 of the mandrel 100. Two screws 712, 714 located in the two threaded through holes and enter into the mill slots 107, 108 of the mandrel 100 respectively, and the screws 712,714 are restrained within the mill slots 107, 108 of the mandrel 100 as the first anti-rotation means, while still moving within the mill slots 107, 108 freely such that the lock ring retainer 702 can slide over mandrel 100 along the longitudinal axis 101 of the mandrel 100. The upper ends of the mill slots 107, 108 are on the shearable portion 102 of the mandrel 100.

The process of setting the plug 50 is divided into several stages according to different setting forces applied to the plug 50. In the first stage, a first setting force is applied to the plug 50, that is, the first setting force is downwardly applied to the locking ring 800 and lock ring retainer 702 while the mandrel 100 is pulled upwardly by the ram 704 which is threadingly secured to the shearable portion 102 of the mandrel 100. The tool sleeve 703 directly pushes the lock ring 800 and the lock ring retainer 702 against the centralizer 600, and the centralizer 600 translates the push force to components on the mandrel 100, such as the backup ring 200,500, the end elements 300, 350, the central element 400, the cone 140 and the slip 130 toward the bottom locking ring 120 while the mandrel 100 pulls these components in the opposite direction. The setting force exerting on the mandrel 100 produces a pulling force between the shearable portion 102 and the mandrel 100.

The first setting force is smaller than the force required to shear the shearable threads between the cone 140 and the mandrel 100 in the embodiments with a shearable connection between the cone 140 and the mandrel 100. In this case, the cone 140 remains stationary relative to the mandrel 100, thus the slip 130 between the cone 140 and the bottom locking ring 120 is not subjected to pressure and also remains stationary. The first force is also smaller than the pulling force required to separate the shearable portion 102 from the mandrel 100. As a result, the components around the mandrel 100 between the lock ring retainer 702 and the cone 140 are subjected to pressure and start to be compressed, thereby causing the backup rings 200, 500, the central element 400 and the end elements 300, 350 to begin to expand but not reach the casing wall. The flanges 630 of the centralizer 600 radially expand out over the backup ring 500 and are forced against the casing wall, thereby shortening the overall length of these components and a part of the shearable portion 102 is exposed to face the lock ring retainer 702. When this happens, the plug 50 and the casing of the well are concentric, therefore each individual slip segment 132 of the slip 130 has the same distance to the casing wall.

In the second stage, a second setting force is applied to the plug 50, the second force is larger than the force required to shear the shearable threads between the cone 140 and the mandrel 100 for the embodiments with a shearable connection between the cone 140 and the mandrel 100 but is still smaller than the pulling force required to separate the shearable portion 102 from the mandrel 100. In this case, the shearable threads between the cone 140 and the mandrel 100 are sheared, releasing the cone 140 engaged with the mandrel 100, thus allowing the cone 140 to freely slide on the surface of mandrel 100. The second setting force makes the cone 140 move towards the slip 130, the sloped outer surface 141 of the cone 140 can translate axial forces to outward radial forces in the slip 130. In this way, the slip 130 can experience outward radial forces and is broken into a plurality of slip segments 132 to engage an inner surface of a surrounding casing wall. In this process, the slip 130 is concentric with the casing because of the centralizer 600, therefore, the slip segments 132 may be uniformly disposed around the inside walls of the casing. This uniform position of the slip segments 132 results in even stress distribution around the mandrel 100, thereby improving the axial load capacity of the slip 130. The second setting force can further compress the backup ring 200,500, the central element 400 and the end elements 300, 350, thereby expanding the central element 400 into contact with the wall of the casing. As the setting force increases, the rate of deformation of the central element 400 and the end elements 300, 350 decreases. The compressed slip 130 and other components on the mandrel 100 make all the components on the mandrel 100 move towards the bottom locking ring 120, thus exposing more of the shearable portion 102 to the tool sleeve 703.

In the third stage, a third setting force is applied to the plug 50, which is larger than the second force but is still smaller than the pulling force required to separate the shearable portion 102 from the mandrel 100. In this stage, the third setting force further compresses the central element 400 and the end elements 300, 350 and causes them to radially expand so that the central element 400 presses the wall of the casing and securely seals the casing. Once the rate of deformation of the central element 400 and the end elements 300 is negligible, all the components on the mandrel 100 cease to move towards the bottom locking ring 120. In this case, the whole shearable portion 102 is exposed to face the tool sleeve 703. That is, no components of the plug 50 cover the outer surface of the shearable portion 102.

In the fourth stage, a fourth setting force, which is larger than the pulling force required to separate the shearable portion 102 from the mandrel 100, is applied to the plug 50. That is, the fourth setting force is downwardly applied to the centralizer 600 and the locking ring 800 via the tool sleeve 703 while the mandrel 100 is pulled upwardly by the ram 704 which is threadably secured to the shearable portion 102 of the mandrel 100. The fourth setting force exerted on the mandrel 100 produces a pulling force between the shearable portion 102 and the mandrel 100 which is larger than the pulling force required to separate the shearable portion 102 from the mandrel 100. As a result, the shearable portion 102 separates from the mandrel 100 and then the shearable portion 102 is taken out of the wellbore by the setting tool 700 due to the threaded connection between the shearable portion 102 and the ram 704 of the setting tool 700. Thus, the process of setting the plug 50 is finished.

Referring back to FIGS. 1A, 1B, 10 and 14, when a setting force is applied to the frac plug 50, the lock ring 800 may move from a first position on the threaded outer surface 109 in the unexpanded configuration of the sealing elements and ratchet over the ratchet thread disposed on the outer surface or threaded outer surface 109 of the upper end of mandrel 100. Due to the configuration of the mating threads and the extending slot 806 of the lock ring 800, after the force is removed (the setting tool 700 removed), the locking ring 800 does not move or return upward from a second position on the threaded outer surface 109, such that the compressed components (sealing elements 300, 350, 400 in an expanded configuration, the upper back up ring 500, and the centralizer 600) and lock ring retainer 702 will remain firmly secured within the casing relative to the bottom locking ring 120. All pressure to return to the unexpanded configuration by the compressed components are now exerted on the lock ring 800.

Advantageously, embodiments disclosed herein may provide short plug 50 due to the shearable portion 102 which can be separated from the mandrel 100 after the plug 50 is set. Thus, if plug removal is required, milling time would be greatly reduced.

In order to further reduce the length of the plug 50, advantageously, a lock ring retainer 702 and centralizer 600 replace an upper slip. A conventional lock ring retainer sits on top of the lock ring to push the lock ring and prevent the lock ring from coming loose from the mandrel as it is run downhole. The conventional lock ring and the conventional lock ring retainer have no pressure relationship to the sealing elements or other compressed components. After the plug is set, the conventional lock ring retainer stays on the mandrel and occupies a certain space in the plug, which increases the length of the plug. Referring back to FIGS. 1A, 1B, 13 and 14, the plug 50 provided by an embodiment disclosed herein provides a lock ring retainer 702 and lock ring 800 in a different relationship to the compressed components, such as the sealing elements 300, 350, 400 in the expanded configuration of FIG. 1B. Instead, the lock ring retainer 702 and lock ring 800 have an important function. Without an upper sleeve, the length of the plug 50 can be further reduced, while the slip 130 can still be centered when compressed. This means that there is less material to be milled out.

To remove the plug from the wellbore, the plug can be drilled out, milled, or otherwise compromised. As it is common to have two or more plugs located in a single wellbore to isolate multiple zones therein, during removal or one or more plugs from the wellbore some remaining portion of a first, upper plug can release from the wall of the wellbore at some point during the drill out. Thus, when the remaining portion of the first, upper plug falls and engages an upper end of a second, lower plug, the anti-rotation features of the remaining portions of the plugs will engage and prevent, or at least substantially reduce relative rotation therebetween. For example, the lower end of the upper plug can be prevented from rotating within the casing by the interaction with the upper end of the lower plug, which is held securely within the casing, and thus, may increase efficiency of the procedure. Conventional anti-rotation features that can be used with a plug to prevent rotation during drill-out are generally arranged at the end of the plug, and thus increase the length of the plug.

Figure 11:
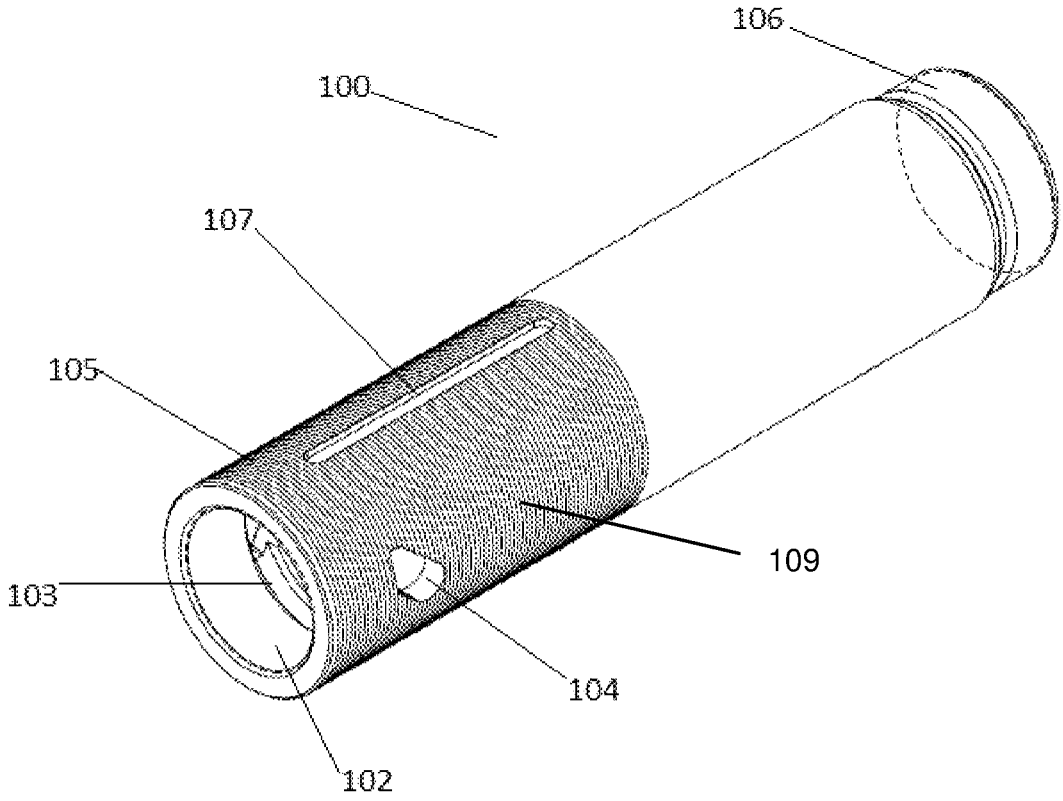
FIG. 11 is a perspective view of a mandrel in accordance with embodiments disclosed herein.
Figure 12:
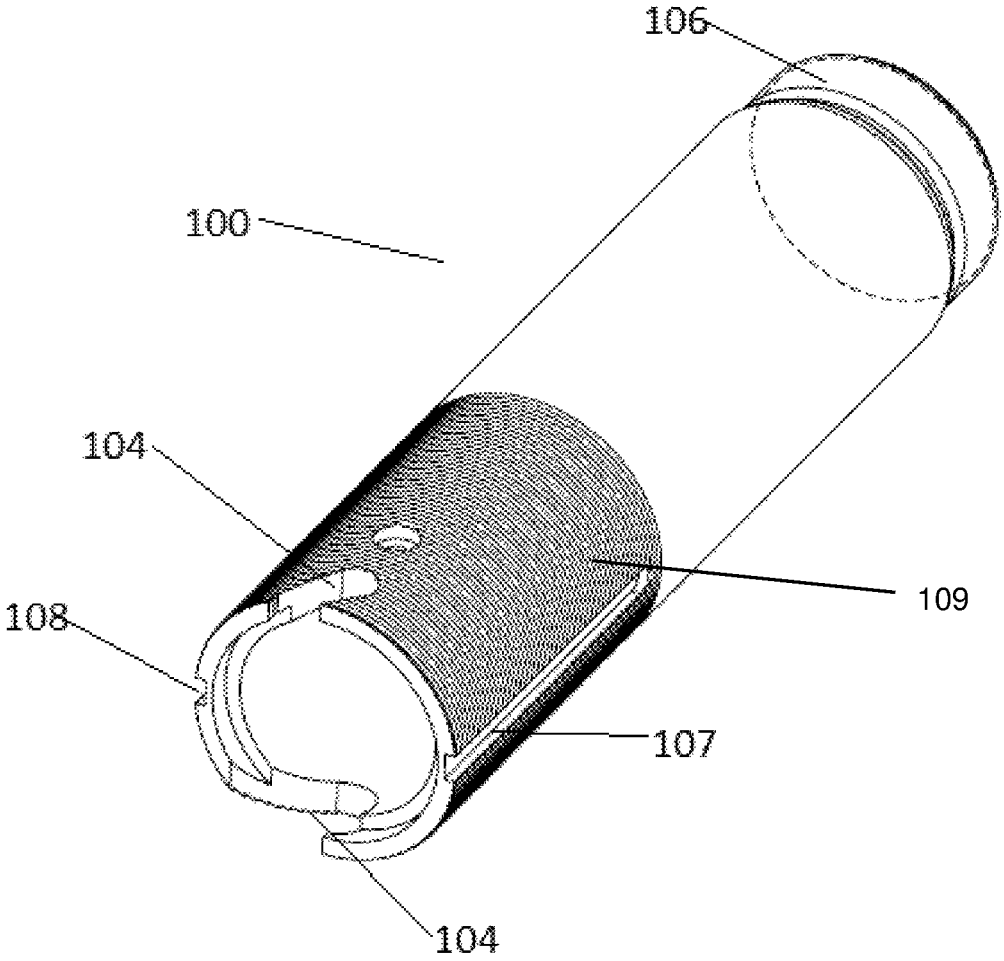
FIG. 12 is a perspective view of a mandrel in FIG. 11 in a sheared condition in accordance with embodiments disclosed herein.
Figure 13:
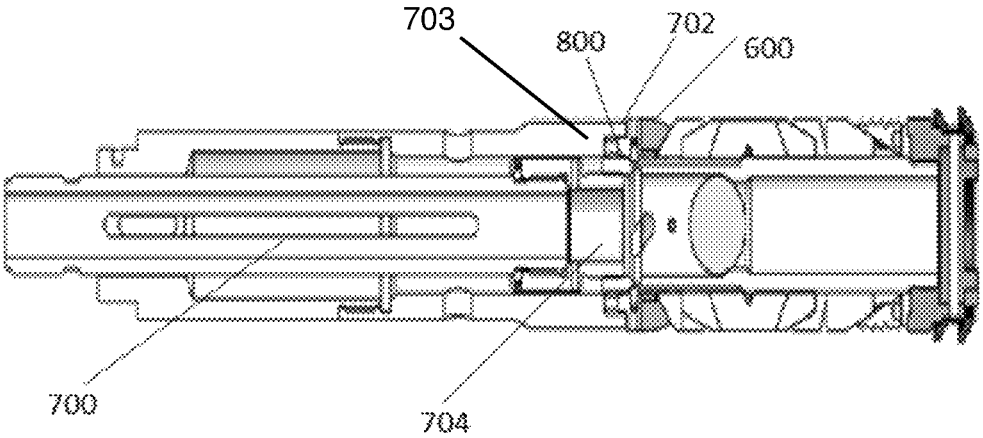
FIG. 13 is a cross-sectional view of setting a frac plug in accordance with embodiments disclosed herein.
Figure 14:
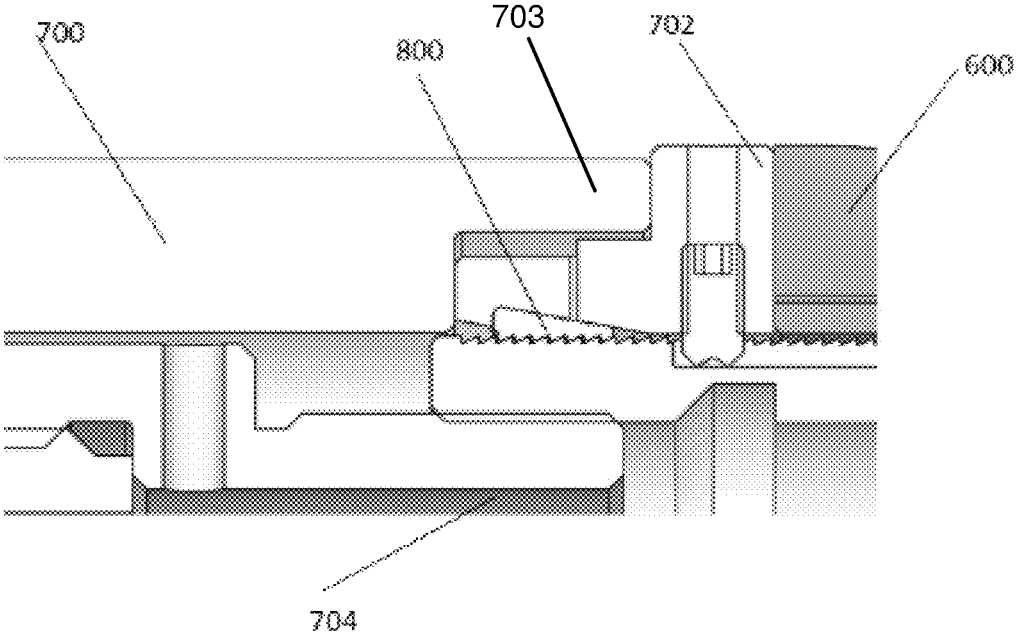
FIG. 14 is a partial cross-sectional view of setting a frac plug of FIG. 13 in accordance with embodiments disclosed herein.

In order to still further reduce the length of the plug 50, advantageously a plug 50 with mill out slot feature and retainer bar 150 as a second anti-rotation means is provided by an embodiment disclosed herein. Many of these plugs 50 are set in the horizontal portion of the well. When milling them out, they will land on top of each other as the coil tubing bit pushes them down the well. Referring back to FIGS. 1, 11 and 12, to keep the upper and lower plug locked together during milling, the plug 50 has both slots 108 as the first anti-rotation means, at the middle of the mandrel 100 and a retainer bar 150 at the bottom thereof.

As discussed previously, the slots 104, 107, 108 at the middle of the mandrel 100 are exposed once the plug is set. The mill slot 108 becomes exposed because the shearable portion 102 of mandrel 100 will shear just above the slot during setting. Putting the mill out slots 108 in the middle of the mandrel 100 instead of the end face of the mandrel 100 will allow the shearable portion 102 above the mill slots 108 on the mandrel 100 to be taken out of the casing with the setting tool 700 after the plug 50 is set, which will reduce the mill-out length of the frac plug 50 and the material left in casing for milling out.

Once the milling tool mills through the slips of the upper frac plug, the remainder of this upper plug will fall onto the lower plug. The retainer bar 150 from the upper plug can then engage with the slot 104, 107 or 108 on the lower plug. This will lock the upper plug and lower plug in place. It is to be understood that the mill out slot 108 shown in the figures above is just one type of mill out feature and is just an example. The mill out slot can be any other geometry or feature used for mill out, such as an angled surface, a half-mule anti-rotation feature, and a dog clutch type anti-rotation feature.

While select embodiments of the present disclosure describe certain features of a frac plug, one of ordinary skill in the art will appreciate that features discussed herein may be applicable to both frac plugs and bridge plugs, and the use of the term frac plug is not intended to limit the scope of embodiments to solely frac plugs.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. All such similar substitutes and modifications apparent to those skilled in the art are deemed to be within the spirit, scope and concept of the disclosure as defined by the appended claims

What is claimed is:

1. A plug comprising:

a mandrel having an upper end, a lower end opposite said upper end, and a threaded outer surface at said upper end;

a plurality of sealing elements disposed around said mandrel;

an upper backup ring disposed around said mandrel and above said sealing elements;

a lower backup ring disposed around said mandrel and below said sealing elements;

a cone disposed around said mandrel and below said lower backup ring, said cone being comprised of a sloped outer surface;

a slip disposed around said mandrel and adjacent said sloped outer surface of said cone, said slip being comprised of a plurality of slip segments and a plurality of recessed regions, said slip being the only slip disposed around the mandrel;

a bottom locking ring fixed to said mandrel below said slip;

a centralizer disposed around said mandrel and above said upper backup ring;

a lock ring retainer disposed around said mandrel and above said centralizer; and a lock ring being in one way threaded engagement with said threaded outer surface and disposed above said lock ring retainer, wherein when said sealing elements have an unexpanded configuration, said locking ring being set at a first position on said threaded outer surface relative to said sealing elements so as to resist no pressure exerted by said sealing elements against said locking ring away from said lower back up ring, and wherein when said sealing elements have an expanded configuration, said locking ring being set at a second position on said threaded outer surface relative to said sealing element so as to resist all pressure exerted by said sealing elements and said lower backup ring against said upper backup ring, said centralizer, and said lock ring retainer away from said bottom locking ring, said second position being closer to said bottom locking ring than said first position.

2. The plug of claim 1, wherein said plurality of sealing elements is comprised of a center element, an upper end element above said center element, and a lower end element below said center element.

3. The plug of claim 1, further comprising: a seal disposed around said bottom locking ring.

4. The plug of claim 1, wherein said plurality of slip segments are integral with each other in said unexpanded configuration of said plurality of sealing elements, and wherein said plurality of slip elements are split from each other and said plurality of recessed regions are split from each other in said expanded configuration of said plurality of sealing elements so as to secure said slip to a casing.

5. The plug of claim 4, wherein said plurality of slip elements are centered around said mandrel in a pattern determined by said centralizer in said expanded configuration.

6. The plug of claim 1, wherein said mandrel is further comprised of a shearable portion at said upper end of said mandrel, an undercut adjacent to said shearable portion and between said shearable portion and said lower end of said mandrel, and a first anti-rotation means adjacent to said undercut and closer to said bottom locking ring than said undercut, wherein said unexpanded configuration corresponds to at least said lock ring retainer and said centralizer covering said first anti-rotation means and at least said lock ring retainer covering said undercut, wherein said unexpanded configuration corresponds to said first position of said lock ring being between said upper end of said mandrel and said first anti-rotation means, and wherein said expanded configuration corresponds to said second position of said lock ring being between said undercut and said lower end of said mandrel so as to expose said first anti-rotation means at said undercut.

7. The plug, according to claim 6, wherein said mandrel is further comprised of a second anti-rotation means at said lower end of said mandrel.

8. A plug comprising:

a mandrel having an upper end, a lower end opposite said upper end, and a threaded outer surface at said upper end;

a plurality of sealing elements disposed around said mandrel;

an upper backup ring disposed around said mandrel and above said sealing elements;

a lower backup ring disposed around said mandrel and below said sealing elements;

a cone disposed around said mandrel and below said lower backup ring, said cone being comprised of a sloped outer surface;

a slip disposed around said mandrel and adjacent said sloped outer surface of said cone, said slip being comprised of a plurality of slip segments and a plurality of recessed regions;

a bottom locking ring fixed to said mandrel below said slip;

a lock ring retainer disposed around said mandrel and above said upper backup ring; and a lock ring being in one way threaded engagement with said threaded outer surface and disposed above said lock ring retainer, wherein said sealing elements have an unexpanded configuration, said locking ring being set at a first position on said threaded outer surface relative to said sealing elements so as to resist no pressure exerted by said sealing elements against said locking ring away from said lower back up ring, and wherein said sealing elements have an expanded configuration, said locking ring being set at a second position on said threaded outer surface relative to said sealing element so as to resist all pressure exerted by said sealing elements against said upper backup ring and said lock ring retainer away from said lower back up ring, said second position being closer to said lower back up ring than said first position, wherein said mandrel is further comprised of a shearable portion at said upper end of said mandrel, an undercut adjacent to said shearable portion and between said shearable portion and said lower end of said mandrel, and a first anti-rotation means adjacent to said undercut and closer to said bottom locking ring than said undercut, wherein said unexpanded configuration corresponds to at least said lock ring retainer covering said first anti-rotation means and at least said lock ring retainer covering said undercut, wherein said unexpanded configuration corresponds to said first position of said lock ring being between said upper end of said mandrel and said first anti-rotation means, and wherein said expanded configuration corresponds to said second position of said lock ring being between said undercut and said lower end of said mandrel so as to expose said first anti-rotation means at said undercut.

9. The plug, according to claim 8, wherein said mandrel is further comprised of a second anti-rotation means at said lower end of said mandrel.

10. The plug of claim 8, wherein said plurality of sealing elements is comprised of a center element, an upper end element above said center element, and a lower end element below said center element.

11. The plug of claim 8, further comprising: a seal disposed around said bottom locking ring.

12. The plug of claim 8, wherein said plurality of slip segments are integral with each other in said unexpanded configuration of said plurality of sealing elements, and wherein said plurality of slip elements are split from each other and said plurality of recessed regions are split from each other in said expanded configuration of said plurality of sealing elements so as to secure said slip to a casing.

13. The plug of claim 8, further comprising: a centralizer disposed around said mandrel and above said upper backup ring, wherein said expanded configuration corresponds to said locking ring being set at a second position on said threaded outer surface relative to said sealing element so as to resist all pressure by said sealing elements against said upper backup ring, said centralizer, and said lock ring retainer, away from said lower back up ring.

14. The plug of claim 13, wherein said plurality of slip segments are integral with each other in said unexpanded configuration of said plurality of sealing elements, and wherein said plurality of slip elements are split from each other and said plurality of recessed regions are split from each other in said expanded configuration of said plurality of sealing elements so as to secure said slip to a casing, and wherein said plurality of slip elements are centered around said mandrel in a pattern determined by said centralizer in said expanded configuration.

15. A method of installing in a wellbore, the method comprising the step of:

running in a plug, according to claim 1, in said unexpanded configuration, into a casing of the wellbore, with a setting tool being comprised of a ram removably attached to said upper end of said mandrel and a tool sleeve adjacent said lock ring and said lock ring retainer;

holding said plug in a desired location by said setting tool positioning said mandrel and said bottom locking ring in place;

applying an upward axial force to said mandrel and said bottom locking ring by said ram; and applying a downward axial force to said lock ring and said lock ring retainer by said tool sleeve so as to compress said plurality of sealing elements to said expanded configuration, wherein the step of applying said downward axial force is further comprised of:

radially expanding said centralizer; and radially expanding said slip so as to engage said casing, after the step of radially expanding said centralizer, and wherein said plurality of sealing elements are radially expanded to said expanded configuration so as to create a seal between said mandrel and said casing.

16. The method of installing, according to claim 15, wherein said mandrel is further comprised of a shearable portion at said upper end of said mandrel, an undercut adjacent to said shearable portion and between said shearable portion and said lower end of said mandrel, and a first anti-rotation means adjacent to said undercut and closer to said bottom locking ring than said undercut, wherein said unexpanded configuration corresponds to at least said lock ring retainer and said centralizer covering said first anti-rotation means and at least said lock ring retainer covering said undercut, wherein said unexpanded configuration corresponds to said first position of said lock ring being between said upper end of said mandrel and said first anti-rotation means, and wherein said expanded configuration corresponds to said second position of said lock ring being between said undercut and said lower end of said mandrel so as to expose said first anti-rotation means at said undercut, and wherein the step of applying said downward force further comprises:

moving said lock ring from said first position to said second position, said second position being past said undercut.

17. The method of installing, according to claim 16, said method further comprising the steps of:

shearing said shearable portion at said undercut with said lock ring being in said second position so as to separate said setting tool from said plug; and removing said setting tool from said casing.

18. The method of installing, according to claim 16, wherein the step of applying said downward force further comprises the step of:

increasing downward force after the step of radially expanding said centralizer.

19. A method of installing in a wellbore, the method comprising the step of:

running in a plug, according to claim 8, in said unexpanded configuration, into a casing of the wellbore, with a setting tool being comprised of a ram removable attached to said mandrel at said upper end and a tool sleeve adjacent said lock ring and said lock ring retainer;

holding said plug in a desired location by said setting tool positioning said mandrel and said bottom locking ring in place;

applying an upward axial force to said mandrel and said bottom locking ring by said ram; and applying a downward axial force to said lock ring and said lock ring retainer by said tool sleeve so as to compress said plurality of sealing elements to said expanded configuration, wherein the step of applying said downward axial force is further comprised of:

radially expanding said centralizer; and radially expanding said slip so as to engage said casing, after the step of radially expanding said centralizer, and wherein said plurality of sealing elements in said expanded configuration are radially expanded so as to create a seal between said mandrel and said casing.

20. The method of installing, according to claim 19, said method further comprising the step of:

shearing said shearable portion at said undercut with said lock ring being in said second position so as to separate said setting tool from said plug; and removing said setting tool from said casing.

* * * * *